US005599240A

United States Patent [19]

Feldmeier

[11] Patent Number: 5,599,240

[45] Date of Patent: Feb. 4, 1997

[54] GOLF TRAINING DEVICE

[76] Inventor: Toni Feldmeier, Frauenried 3, D-83737 Irschenberg, Germany

[21] Appl. No.: 544,437

[22] Filed: Nov. 17, 1995

[30] Foreign Application Priority Data

Nov. 9, 1995 [DE] Germany ..... 195 41 842.5

[51] Int. Cl.[6] ..... A63B 69/36

[52] U.S. Cl. ..... 473/218; 473/261; 473/265; 473/264; 473/271; 473/272; 473/273; 473/277

[58] Field of Search ..... 473/218, 261, 473/264, 265, 270, 271, 272, 273, 277

[56] References Cited

U.S. PATENT DOCUMENTS 4,699,384 10/1987 Bechler et al. ..... 473/264

5,013,044 5/1991 Hesselbart ..... 473/218

5,255,921 10/1993 Spence ..... 473/218

*Primary Examiner*—George J. Marlo

*Attorney, Agent, or Firm*—Dennison, Meserole, Pollack & Scheiner

[57] ABSTRACT

The invention relates to a golf training device including a base element (1) resting on the ground, which is directed toward the target hole, a guide rod (2) fastened thereon at an angle by an intermediate element (3), also resting on the ground, a barrier in the form of a resilient rod (5) attached to the guide rod (2) by a tensible bearing element (4). The guide rod (2) can be positioned at right angles with the base element (1) by the intermediate element (3). The tensible bearing element (4) includes a portion (6) which can be connected with the resilient rod (5) and the bearing element (4) can be fixed in place on the guide rod (2) at different angles in respect to the base element (1).

20 Claims, 4 Drawing Sheets

FIG. 3
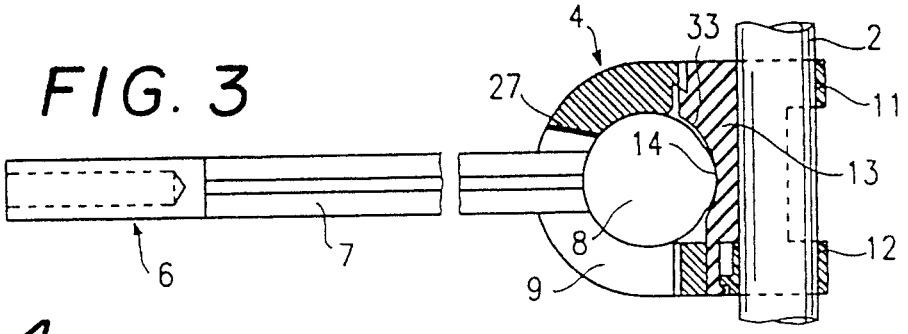
FIG. 4
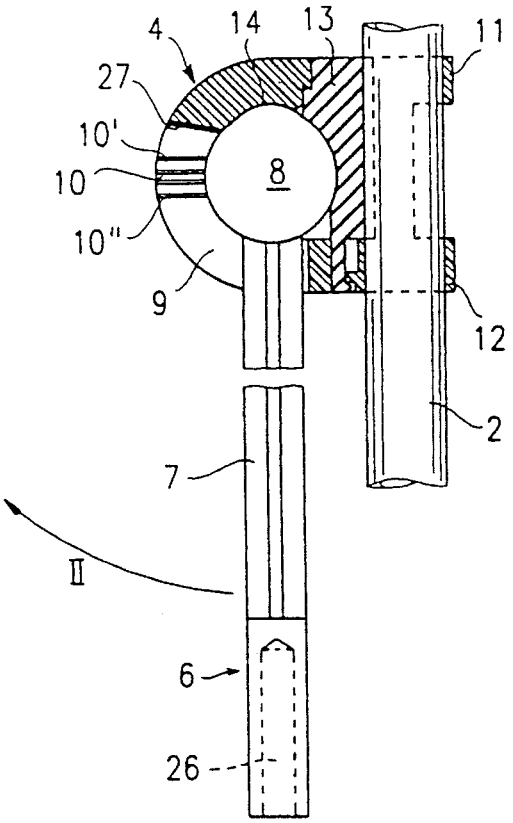
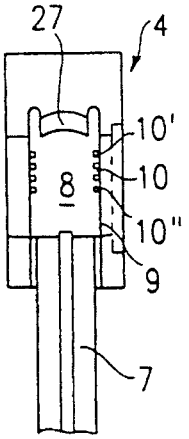
FIG. 5
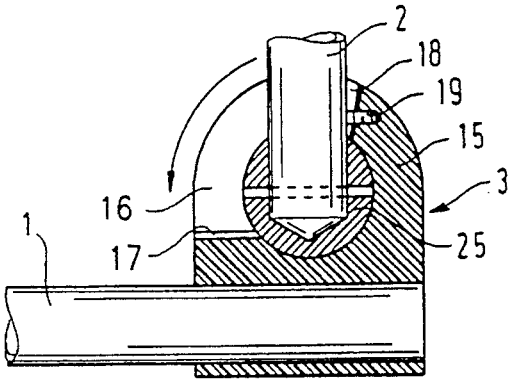
FIG. 6
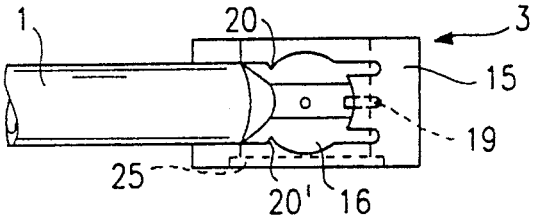
FIG. 7

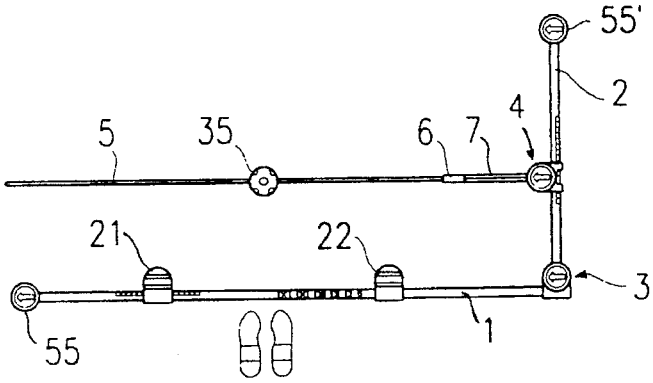
FIG. 8a
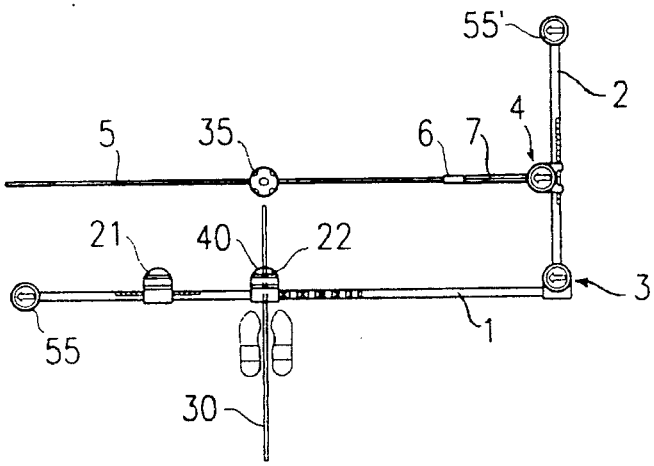
FIG. 8b
FIG. 8c
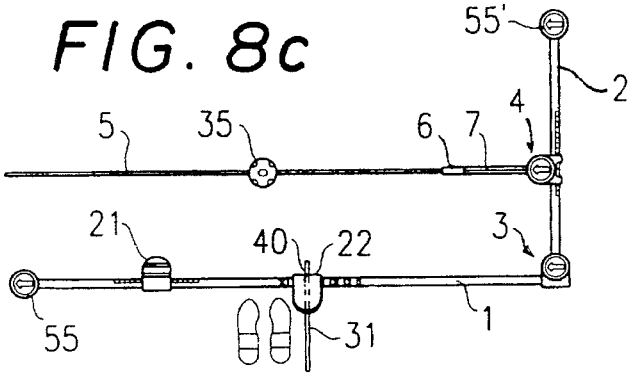
FIG. 8e
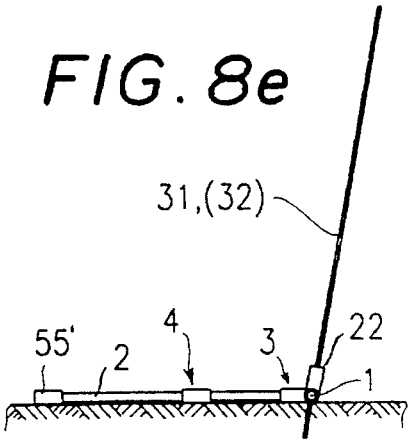
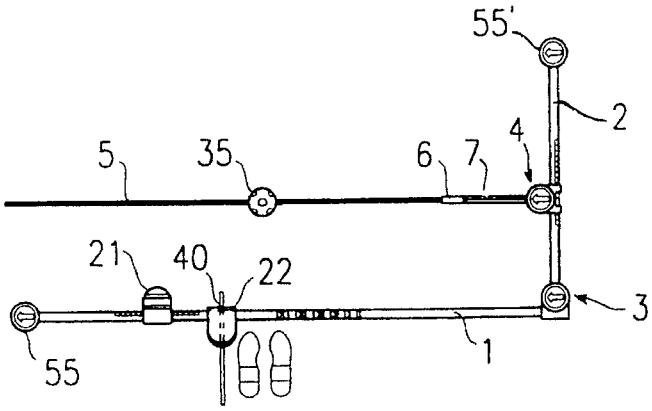
FIG. 8d

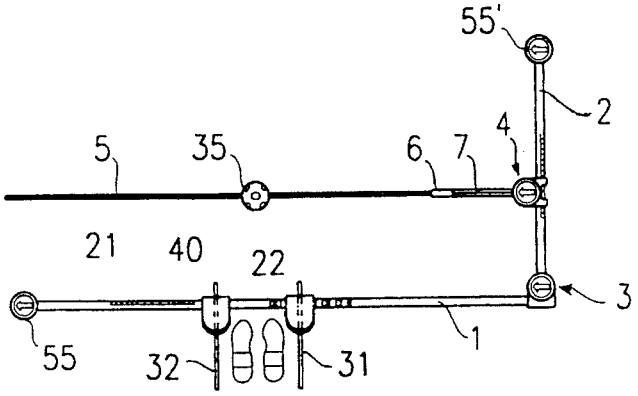
FIG. 8f
FIG. 8g
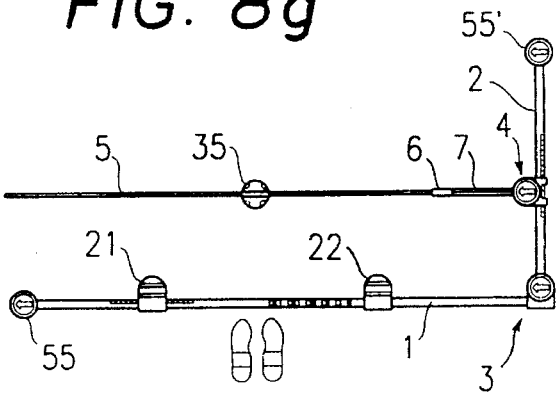
FIG. 8h
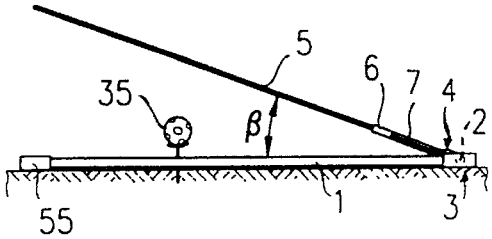
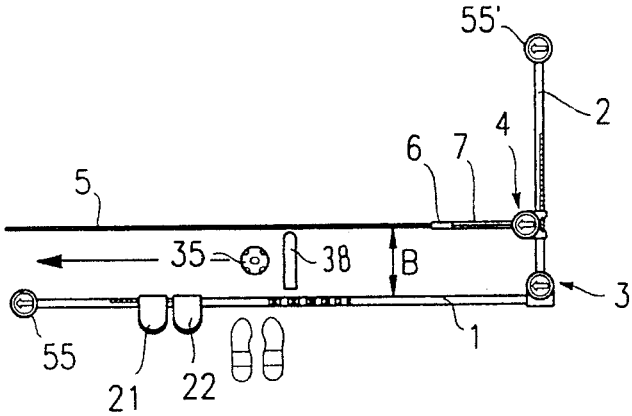
FIG. 8i

GOLF TRAINING DEVICE

BACKGROUND OF THE INVENTION

The invention relates to a golf training device with a base element resting on the ground, which is directed toward the target hole, and with a guide rod fastened thereon at an angle by means of an intermediate element and also resting on the ground, to which a barrier in the form of a resilient rod can be attached via a tensible bearing element.

Such a golf training device is already known as prior art (U.S. Pat. No. 4,699,384 or EP 0 255 846 B1). In this known structure the guide rod is embodied as a segment of a circle, wherein sleeves, secured by screws, are disposed on the base element as well as on the guide rod. Although this device works satisfactorily, appropriate tools must always be available for bringing the individual elements of this golf training device into a functionally correct position. Further than that, this known device is mainly used to improve the golf swing by the presence of a spatially extending guide path cooperating with the club face of a golf club.

In the further prior art training device, a spherically extending curve is seated on a base element along which the club head of a golf club must be passed in order to execute a functionally correct swing (U.S. Pat. No. 2,807,472). This device is constructed in a very complicated manner and accordingly is expensive. Further golf training devices employ a frame-like stand (U.S. Pat. No. 2,813,721), use photoelectric barriers (U.S. Pat No. 3,776,55), use marker poles (U.S. Pat. No. 3,942,807, U.S. Pat. No. 4,322,084) or use a cross element on which poles which can be displaced parallel to each other are disposed (U.S. Pat. No. 4,023,811).

These known devices are either elaborately constructed or complicated to manipulate.

OBJECT OF THE INVENTION

It is the object of the instant invention to design a golf training device of the type mentioned at the outset in such a way that an increased field of application is achieved along with simple operability.

This object is attained in accordance with the invention in that the guide rod, which is embodied straight, can be positioned at right angles with the base element by means of the intermediate element, and that the bearing element has an area which can be connected with the rod, by means of which the bearing element can be fixed in place on the guide rod at various angles in respect to the base element. This results in the advantage of a simply constructed training device which can be changed from a folded-up, easily transported state into the operating position without additional tools, wherein, as a result of the specific design of the individual elements, this operating position makes it possible to assure a large number of functions for improving the functionally-correct posture of the male or female golfer. The golf training device in accordance with the invention can be used for putting as well as driving.

In a further embodiment of the invention, the bearing element can be fixable in place on the guide rod parallel with and at at least one greater and at least one lesser angle in respect to the base element. This results in a further field of application, in particular for improving the golf swing during a wide tee-off in order to prevent so-called "slicing" or "hooking" strokes from the start.

In a further embodiment of the invention, the area of the bearing element which can be connected with the rod can be embodied as a sleeve, wherein the sleeve is connected via a profiled intermediate area with a bearing journal seated in the bearing element. In this case the bearing element can have a recess, through which the profiled intermediate area can pass, and which is provided with stops for the various angled positions of the rod in respect to the base element. Thus the male or female golfer merely needs to displace the intermediate area in relation to the bearing element in order to assure the desired position of the resilient rod which controls the drive.

In respect to the design of the bearing element, a particularly simple structure results if two areas extend around the guide rod and if the bearing element has an elastic stop on the side opposite the areas, which can be acted upon by the bearing journal. In this way the bearing element can be fastened in the desired position in a functionally assured manner on the guide rod simply by rotating the sleeve.

To position the guide rod in the operating position correctly at right angles in respect to the base element, in further development of the invention the intermediate element can have a housing surrounding the base element, which is provided with a cutout for the passage of the guide rod. This cutout can be equal or greater than 90°; if the cutout is greater than 90°, an adjustment element is inserted at the appropriate limiting wall, by means of which it is possible to achieve the 90° position of the guide rod very exactly.

For further easement of this operating position, the housing can have two stop projections located opposite each other, behind which the guide rod is locked in place.

To assign further functions to the golf training device in accordance with the invention, at least one linearly displaceable holding element for seating at least one orienting rod for the functionally correct posture of a golfer can be disposed on the base element.

Preferably two identically embodied holding elements are employed, which are provided with openings which extend perpendicularly and, at the front face obliquely, for seating respectively one orienting rod. It is possible by means of this to achieve the correct addressing posture as well as the avoidance of so-called "slicing" strokes. By means of these orienting rods it is further possible for the male or female golfer to take up the correct swing level.

The base element and the guide rods can respectively be provided with markings to improve the orientation and for the correct adjustment of the individual element in accordance with the height of the male or female golfer.

There is the further option to provide the intermediate element and/or the bearing element, as well as closure elements at the front faces of the base element and the guide rod, with marker arrows pointing to the target.

In addition, regarding the golf training device of the invention, a simple structure from the viewpoint of cost results because the intermediate element, the bearing element and the holding elements are all made of plastic material.

BRIEF DESCRIPTION OF THE DRAWINGS

FIG. 3, a representation, partially cut, of the bearing element in a top view in the operating position, FIG. 4, a top view of the bearing element in the pivoted in position in section;

FIG. 5, a lateral view of the bearing element in FIG. 4;

FIG. 6, a top view of the intermediate element in the folded-open position in section;

FIG. 7, a lateral view of the intermediate element of FIG. 6;

FIGS. 8*a* to *i*, various application options of the golf training device in accordance with the invention.

DETAILED DESCRIPTION OF THE INVENTION

The invention will now be described with reference to the drawings.

Figure 1:
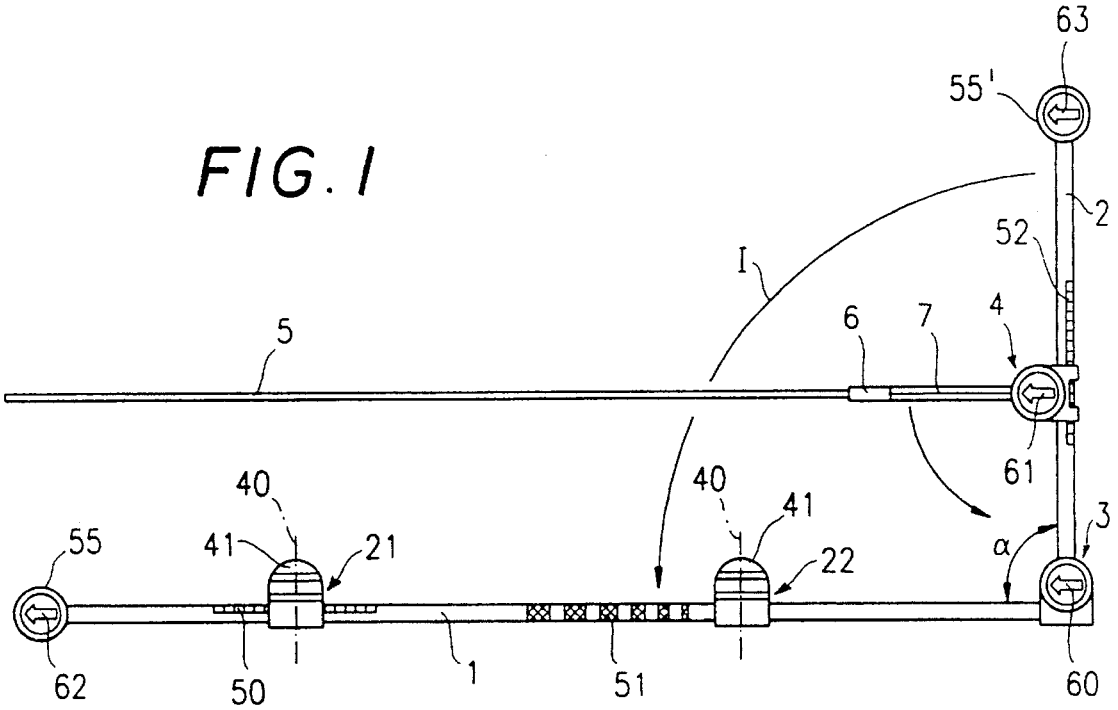
FIG. 1, a top view of the golf training device in accordance with the invention in the operating position, resting on the ground.

In accordance with FIG. 1, the golf training device in accordance with the invention essentially consists of a base element 1, resting on the ground and oriented toward a target hole, not shown, in the form of a rod, and a guide rod 2, also resting on the ground, fastened thereon at an angle via an intermediate element 3. A clampable bearing element 4 is disposed on this guide rod, in which a barrier in the form of a resilient rod 5 can be placed, which rod extends obliquely upwards and limits the inward swing curve of a golf club.

It follows from FIG. 1 that the guide rod 2 is embodied straight and in its operating position is positioned exactly at a right angle α in respect to the base element 1 via the intermediate element 3.

Two linearly displaceable holding elements 21 and 22 are located on the base element 1, are identically designed and respectively have an opening 40 or 41 perpendicularly and obliquely at the front face. The front faces of the base element 1 and of the guide rod 2 are respectively provided with a closure element 55 and 55'. Stops 50, 51 are disposed on the base element 1 and stop 52 on the guide rod 2.

It can be furthermore seen in FIG. 1 that the intermediate element 3, the bearing element 4 and the closure elements 55 and 55' are respectively provided with a marker arrow 60, 61, 62, 63 pointing toward the target hole.

Figure 2:
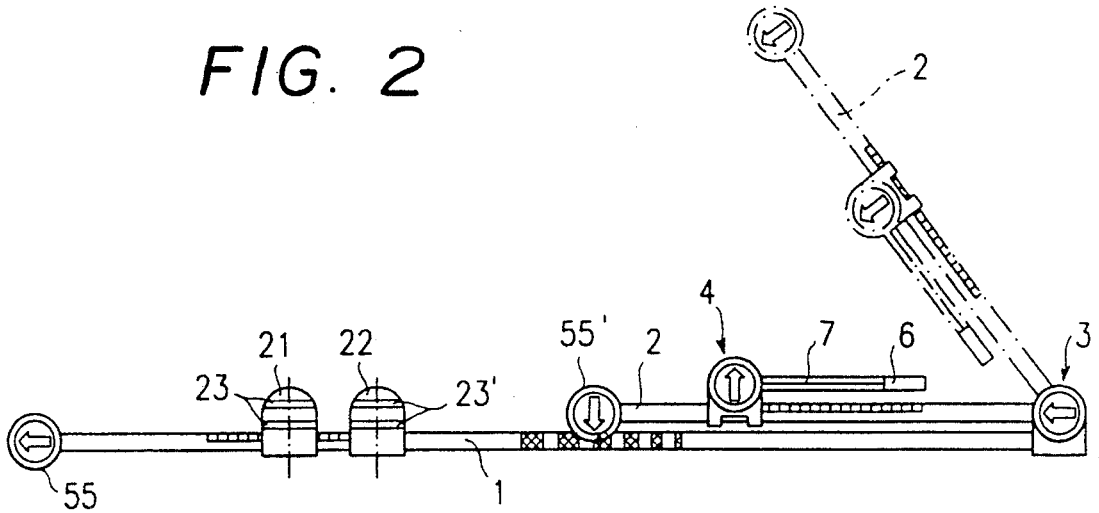
FIG. 2, a top view of the golf training device of FIG. 1 in the folded-up, transportable position.
Figure 1:
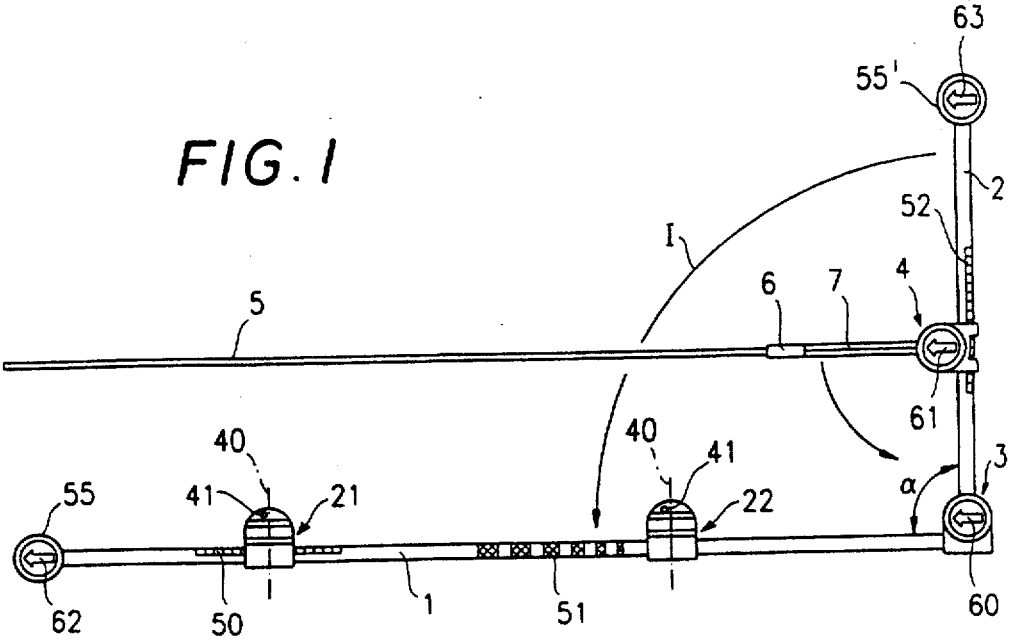
Figure 2:
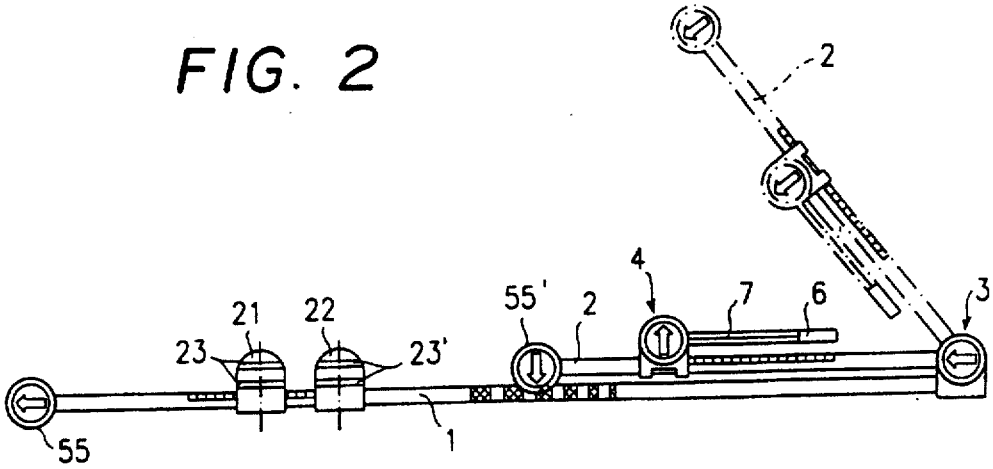

FIG. 2 shows the golf training device in accordance with the invention in the folded-up state: as can be seen, the guide rod 2 has been turned in the intermediate element 3 in the direction of the arrow I past the dashed position into the end position in which it lies parallel in respect to the base element 1. The closure element 55 of the guide rod 2 has a recess and accordingly rests on the base element 1. The bearing element 4 is in the unclamped state and is turned by 180° in respect to the position in accordance with FIG. 1. A sleeve 6 of the bearing element 4 receiving the rod 5 was rotated into a position in which it also lies parallel with the base element 1. Thus, in this position represented in FIG. 2, the golf training device in accordance with the invention can be transported easily and in a space-saving manner.

The bearing element 4 is shown in FIG. 3 in the operating position analogously to the position in FIG. 1. As can be seen, an end portion of the bearing element which can be connected with the rod 5 is embodied as a sleeve 6. This sleeve 6 is connected via a profiled intermediate element 7 with a bearing journal 8, which is rotatably seated in the bearing element 4.

The bearing element 4 has a recess 9 through which the profiled intermediate element 7 passes. This recess 9 extends over approximately 90°. In accordance with FIGS. 4 and 5 it is provided with stops 10, 10' or 10".

These stops cooperate with the profiled intermediate element 7. Via the profiled intermediate element 7 and the sleeve 6, the stop 10 maintains the rod 5 exactly at right angles in respect to the guide rod 2 note FIG. 1; correspondingly, this rod 5 in positioned exactly parallel with the base element 1.

The stop 10' defines an angle greater than 90° in respect to the rod 5, the marking 10" defines an angle less than 90° in respect to the rod 5. In this way it is possible to exactly position this rod 5 in accordance with the desired swing path of a golf club (see FIGS. 8*g* and *h*).

It can be furthermore seen in FIG. 4 that the bearing element 4 surrounds the guide rod 2 over the regions 11 and 12 and has an elastic fixing element 13 on the side located opposite the regions 11, 12. This element 13 acts as a support for the bearing journal 8. The bearing element 4 and the bearing journal 8 are preferably made of "plastic material". For the elastic fixing element 13, rubber is preferred.

The bearing journal 8 is designed in such a way that it is provided with an eccentric zone 14 on the side located opposite the profiled intermediate element 7 for acting on the elastic fixing element 13. In accordance with FIGS. 3 and 4, this elastic fixing element 13 has an appropriate guide curve 33.

In accordance with FIGS. 4 and 5, the sleeve 6 with the intermediate element 7 is in a position of rest. Here the bearing journal 8 does not act with its outer circumference on the elastic fixing element 13 or the guide curve 33.

If the sleeve 6 with the profiled intermediate element 7 is rotated in a clockwise direction in accordance with the arrow II into the position in FIG. 3, the eccentric zone 14 of the bearing journal 8 acts on the corresponding curve 33 of the elastic fixing element 13, so that the latter is pushed against the guide rod 2. Since the bearing element is fastened to the rod 2 over the two areas 11 and 12, a correct and secure holding of the bearing element 4 on the guide rod 2 results in the position shown in FIG. 3 via the eccentric zone 14 and the elastic fixing element 13.

Thus no tools are necessary for moving the bearing element 4 from its position of rest in accordance with FIGS. 4 and 5 into the operating position in accordance with FIG. 3. In this operating position the rod 5 can be inserted into an opening 36 of the sleeve 6, to extend exactly parallel with the base element 1 when the profiled intermediate area 7 acts together with the stop 10, 10', 10".

In the upper area the bearing element 4 has a stop 27 in respect to the recess 9, so that by means of this the sleeve 6 with the profiled intermediate element 7, and thus the rod 5, can only be pivoted out as far as this recess permits.

FIGS. 6 and 7 show the intermediate element 3 connecting the base element 1 with the guide rod 2. As can be seen, this intermediate element 3 has a housing 15 enclosing the base element 1, which is provided with a cutout 16 for the passage of the guide rod 2. This cutout 16 is equal to or greater than 90°. A limiting wall 17 extends parallel with the base element 1. This limiting wall 17 is used as a rest for the guide rod 2 in the folded-up position in accordance with FIG. 2.

The cutout 16 is furthermore bordered by another limiting wall 18 which can be positioned at exactly 90° in respect to the limiting wall 17. Alternatively there is the option for this limiting wall 18 having an angle greater than 90° in respect to the limiting wall 17 an adjustment element 19 inserted into this limiting wall 18. By means of this adjustment element 19 it is possible to cause the exact right-angled position of the guide rod 2 in respect to the base element 1 in connection with the golf training device in accordance with the invention.

If follows from FIG. 7 that in the 90° position of the guide rod 2 the housing 15 of the intermediate element 3 has two oppositely located limiting projections 20 and 20'. Therefore, if the guide rod 2 in the intermediate element 3 is rotated into the position in accordance with FIG. 1, the limiting projections 20 and 20' catch behind the guide rod 2 and maintain it exactly in the 90° position in respect to the base element 1. Furthermore, the wall of the cutout 16 is rounded in this area in order to act on the circumference of the guide rods 2.

The guide rod 2 is seated in a bearing journal 25, which is disposed to rotate inside the housing 15 of the intermediate element 3. The intermediate element 3 and the bearing journal 25 are made of plastic material, and can therefore be easily and cost-effectively produced.

As mentioned at the outset, it is possible to assure a number of training options for the male or female golfer: FIGS. 8*a* to *i* represent various application options of the device in accordance with the invention.

FIG. 8*a* shows the basic position, i.e. The so-called "basic alignment": the base element 1 points with its markings 55 toward the target hole, the guide rod 2 extends at right angles therewith. The resilient rod 5 also rests on the ground, fastened to the guide rod 2 via the bearing element 4 and points in the target position. Since the rod 5 and the base element 1 point toward the target hole, the male or female golfer can now take up the exact position in respect to it.

FIG. 8*b* shows the functionally correct ball position: the base element 1 and the guide rod 2 with the resilient rod 5 are in the position in accordance with FIG. 8*a*. An orienting rod 30 has been pushed into the holding element 22 and points exactly toward the golf ball 35. The male or female golfer can now take up the correct position in respect to the orienting rod 30 which is, on the one hand, correctly aligned with the target hole and, on the other hand, set to the correct ball position. Perfect positioning of the ball is achieved by means of this. An exact picture of where the ball 35 should lie in the correct addressing position is imprinted on the player.

FIG. 8*c* shows the so-called "right knee restriction": the base element 1 and the guide rod 2 as well as the rod 5 are in the initial position in accordance with FIG. 8*a*. Now an orienting rod 31 is inserted, extending obliquely upward, through the opening 40 into the holding element 22 and pushed into the ground. This rod 31 therefore takes up the position in accordance with FIG. 8*e*.

If the golfer now positions himself so closely next to the orienting rod 31 that his knee touches this rod, an intense contact results, which is even increased if the golfer performs a wrong pivot movement during the backswing.

The golfer therefore puts himself so closely next to the obliquely upward extending orienting rod 31 that his knee and hip touch it during the backswing in case of an incorrect pivot movement. The contact by feel occurring in this case is advantageously so intense that an error correction already takes place after a short time.

FIG. 8*d* shows the position of so-called "eliminate slicing". Here an orienting rod 32 is used which is pushed through the opening 40 of the holding element 22 to the left of the player and is pushed into the ground. This orienting rod 32 therefore takes up the identical position in accordance with FIG. 8*e*.

For a modern and very efficient golf swing it is necessary that neither during the back stroke nor during the forward swing does the player depart too far laterally from the perpendicular axis taken up in the initial position, i.e. addressing position. This type of error can be corrected very quickly and lastingly in that the orienting rod 32 is positioned close to the body on the side of the body facing the target. Now, if the golfer moves his hip or the knee too far in the direction of the target when hitting the ball, they touch the orienting rod 32. There is again a contact by feel, which clearly shows the player this wrong behavior.

FIG. 8*f* represents a combination of the arrangement in accordance with FIGS. 8*c* and *d*: as can be seen, one orienting rod 31 and 32 has been placed into the holding parts 21 and 22 respectively to extend obliquely upwards from the ground, analogous to the arrangement in accordance with FIG. 8*c*. The player is now placed between these two orienting rods 31 and 32 and immediately notices any error occurring during the tee-off (in whatever phase).

In the position in accordance with FIG. 8*g* or 8*h*, the rod 5 is at an angle β in respect to the guide rod 2 or the ground. The golf ball 35 is placed under this obliquely extending rod and an attempt is made to hit it with a normal stroke. Now if the player comes to the ball from outside of the target line, he first hits the resilient rod 5. This impact is not only felt, but also noticed acoustically. By means of this the player is in a position to dependably avoid this error in a simple manner during the next swing.

While FIG. 8*f* addresses the importance of the correct plane of swing, and FIGS. 8*g* and *h* correct a wrong stroke of the player by means of the resilient rod 5, FIG. 8*i* shows the possibility to employ the golf training device in accordance with the invention also during putting: here, the resilient rod 5 is pushed via the bearing element 4 and the sleeve 6 closely toward and parallel with the base element 1. In this case the distance B should be such that for very shorts putts the golf club is swung back as straight as possible and straight forward.

The distance B approximately corresponds to the width of the head of the putter, because of which it is possible to perform a very short putt very exactly. If in the course of this the putter head 38 leaves the ideal straight line, it comes into contact either to the left or right with the base element 1 or the resilient rod 5.

For longer putts the rod 5 is slightly raised. The golf ball 35 is placed under the rod and the putt is made. Any deviation from an evenly extending slight putting curve again is noticed through the eyes of the golfer. In this way a feeling is dependably developed as to how good or bad the sequence of motions during putting is.

Besides the position represented in FIGS. 8*a* to *i*, there is also a possibility of a correction in respect to "low hands". At least one of the orienting rods 31 or 32 is placed in an oblique position, namely such that in the addressing position the end is located slightly above the hands of the golfer. It is now important that the hand of the golfer does not touch this rod during the swing.

The two holder elements 21 and 22 are not only used for holding the orienting rods 31 and 32 in various positions, but they can also have continuous cutouts 23 and 23'. These cutouts 23 and 23' are used to hold the orienting rods 31 and 32 securely parallel with the base element 1 in the transporting position in accordance with FIG. 2. By means of this the entire golf training device can be transported in a functionally secure manner when folded together.

The golf training device in accordance with the invention is simply constructed, easy to transport and designed in a very cost-saving manner. It can be easily moved from the position of rest into the operating position without any assisting means and it makes an error correction possible in a simple manner in connection with a large number of golf strokes from a simple putt to a wide tee-off.

I claim:

1. A golf training device including:

a base element (1) resting on the ground, which is directed toward the target hole, a guide rod (2) fastened thereon at an angle by means of an intermediate element (3) also resting on the ground, a barrier in the form of a resilient rod (5) attached by a tensible bearing element (4) wherein, the guide rod (2), which is a straight rod, can be positioned at a right angle (α) with respect to the base element (1) by said intermediate element (3), and the tensible bearing element (4) includes a portion which can be connected with the rod (5), by means of which the bearing element (4) can be fixed in place on the guide rod (2) at various angular positions in respect to the base element (1).

2. A device in accordance with claim 1, wherein the portion of the bearing element (4) can be fixed in place on the guide rod (2) parallel with and with at least one greater and at least one lesser angle in respect to the base element (1).

3. A device in accordance with claim 1 wherein the bearing element (4) has an end portion in form of a sleeve (6) which can be connected with the rod (5).

4. A device in accordance with claim 3, wherein the sleeve (6) is connected via a profiled intermediate element (7) with a bearing journal (8) seated in the bearing element (4).

5. A device in accordance with claim 4, wherein the bearing element (4) has a recess (9), through which the profiled intermediate element (7) can pass, which recess is provided with stops (10, 10', 10") for the various angular positions of the rod (5) in respect to the base element (1).

6. A device in accordance with claim 4, wherein the bearing element (4) extends over two regions (11, 12) around the guide rod (2) and has an elastic element (13) on the side opposite the regions (11, 12), which can be acted upon by the bearing journal (8).

7. A device in accordance with claim 6, wherein the bearing journal (8) is provided with an eccentric zone (14) on the side located opposite the profiled intermediate element (7) for acting on the elastic element (13).

8. A device in accordance with claim 6, wherein the elastic element (13) is made of rubber.

9. A device in accordance with claim 1, wherein the intermediate element (3) has a housing (15) surrounding the base element (1), which is provided with a cutout (16) for the passage of the guide rod (2).

10. A device in accordance with claim 9, wherein the cutout (16) extends over 90°, so that a first limiting wall (17) extends parallel with the base element (1).

11. A device in accordance with claim 9, wherein the cutout (16) extends over more than 90° and an adjustment element (19) for the 90° position of the guide rod (2) is disposed in a second other limiting wall (18).

12. A device in accordance with claim 9 wherein the housing (15) has two stop projections (20, 20') which are located at opposite positions of the guide rod (2).

13. A device in accordance with claim 1, including at least one linearly displaceable holding element (21, 22) for seating at least one orienting rod (30, 31, 32) is disposed on the base element (1) for teaching the functionally correct posture of a golfer.

14. A device in accordance with claim 1 including two identically embodied holding elements (21, 22) disposed on the base element (1), which holding elements have an opening (40, 41) respectively extending perpendicularly and at the front face obliquely, for seating orienting rods (31, 32).

15. A device in accordance with claim 14, wherein the holding elements (21, 22) have cutouts (23, 23') extending parallel with the base element (1) for receiving the orienting rods in the folded-up state of the golf training device.

16. A device in accordance with claim 1, wherein the base element (1) and the guide rod (2) are provided with stops (50, 51, 52).

17. A device in accordance with claim 1, wherein the intermediate element (3) and the bearing element (4) are provided with marker arrows (60, 61, 62, 63) pointing toward the target hole.

18. A device in accordance with claim 1, wherein the front face of the base element (1) and of the guide rod (2) are provided with a closure element (55, 55').

19. A device in accordance with claim 18, wherein each closure element (55, 55') has a marker arrow (62, 63) pointing toward the target hole.

20. A device in accordance with claim 1, wherein the intermediate element (3), the bearing element (4) and the holding elements (21, 22) respectively consist of a plastic material.

* * * * *

UNITED STATES PATENT AND TRADEMARK OFFICE

CERTIFICATE OF CORRECTION

PATENT NO. : 5,599,240

DATED : February 4, 1997

INVENTOR(S) : TONI FELDMEIER

It is certified that error appears in the above-indentified patent and that said Letters Patent is hereby corrected as shown below:

IN THE DRAWINGS:

Please replace Figures 1, 8b, 8c, 8d and 8f, as issued, with Figures 1, 8b, 8c, 8d and 8f, as attached hereto.

Signed and Sealed this

Twentieth Day of May, 1997

*Attest:*

*Attesting Officer*

BRUCE LEHMAN

*Commissioner of Patents and Trademarks*

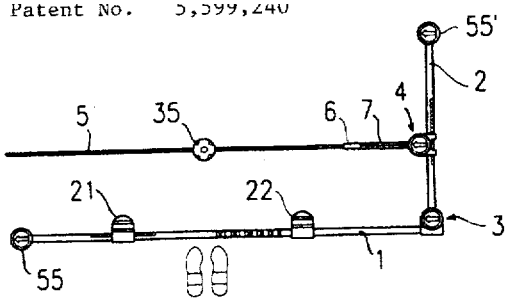
FIG. 8a
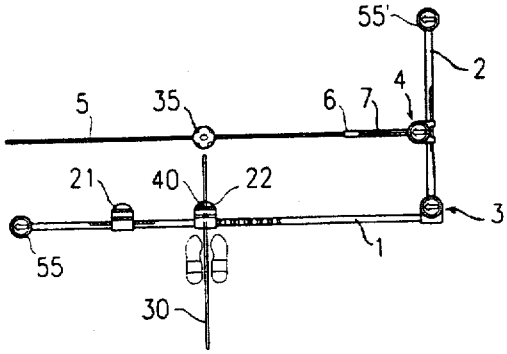
FIG. 8b
FIG. 8c
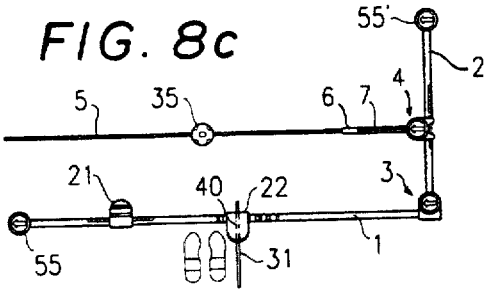
FIG. 8e
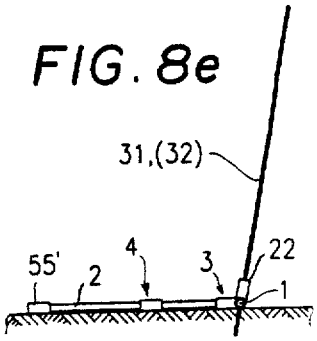
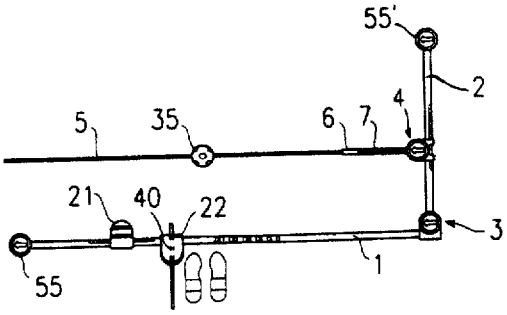
FIG. 8d

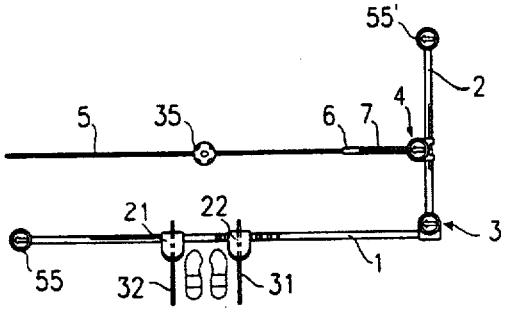
FIG. 8f
FIG. 8g
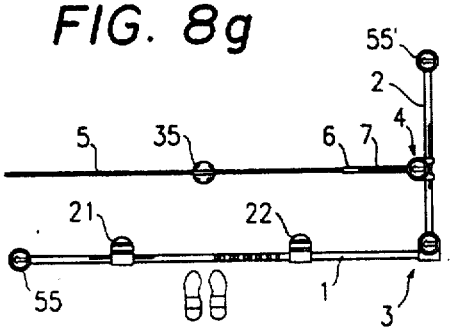
FIG. 8h
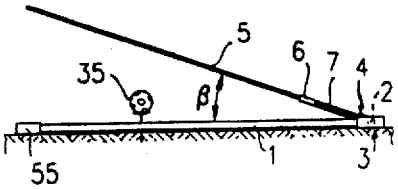
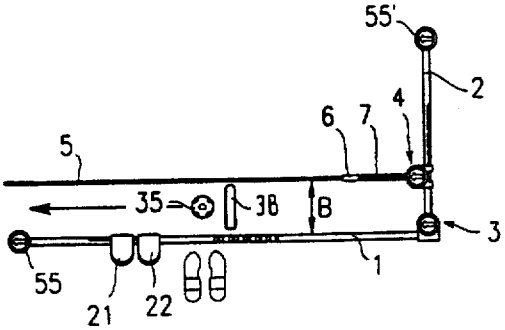
FIG. 8i